US006478832B2

(12) United States Patent
Miura et al.

(10) Patent No.: US 6,478,832 B2
(45) Date of Patent: Nov. 12, 2002

(54) GRINDING STONE, PROCESS FOR ITS PRODUCTION AND GRINDING METHOD EMPLOYING IT

(75) Inventors: Shiro Miura, Aichi (JP); Tsuyoshi Itsukaichi, Aichi (JP)

(73) Assignee: Fujimi Incorporated, Nishikasugai-gun (JP)

( * ) Notice: Subject to any disclaimer, the term of this patent is extended or adjusted under 35 U.S.C. 154(b) by 0 days.

(21) Appl. No.: 09/749,804

(22) Filed: Dec. 28, 2000

(65) Prior Publication Data

US 2001/0005664 A1 Jun. 28, 2001

(30) Foreign Application Priority Data

Dec. 28, 1999 (JP) ..... 11-372154
Nov. 20, 2000 (JP) ..... 2000-352068

(51) Int. Cl.[7] ..... B24D 3/06; B24D 3/00; B24D 3/02; B24D 5/00; B24D 7/00

(52) U.S. Cl. ..... 51/307; 51/308; 51/309; 51/298; 51/293; 451/28; 451/41

(58) Field of Search ..... 51/307, 308, 309, 51/293, 298; 451/28, 41

(56) References Cited

U.S. PATENT DOCUMENTS 4,042,347 A * 8/1977 Sioui ..... 51/298
5,096,661 A * 3/1992 Lang ..... 419/2
5,876,470 A * 3/1999 Abrahamson ..... 51/309
6,187,069 B1 * 2/2001 Hoshi et al. ..... 51/298

* cited by examiner

*Primary Examiner*—Michael Marcheschi
(74) *Attorney, Agent, or Firm*—Oblon, Spivak, McClelland, Maier & Neustadt, P.C.

(57) ABSTRACT

A grinding stone using a metal material as the main material of a bonding material, which comprises:

(A) abrasive grains of at least one member selected from the group consisting of diamond, cubic boron nitride, silicon carbide and aluminum oxide, (B) a bonding material made of at least one metal member selected from the group consisting of cobalt, nickel and copper, or a bonding material made of an alloy comprising at least one member selected from the group consisting of cobalt, nickel and copper, and at least one member selected from the group consisting of iron, silver, tin, zinc and tungsten, and (C) amorphous carbon as an adjuvant, wherein the abrasive grains (A) and the amorphous carbon (C) are distributed in the bonding material (B) in a sea-island structure.

14 Claims, 2 Drawing Sheets

GRINDING STONE, PROCESS FOR ITS PRODUCTION AND GRINDING METHOD EMPLOYING IT

The present invention relates to a grinding stone which is particularly useful for grinding an object to be ground made of an oxide material (a hard brittle material) such as glass or ceramics. More particularly, it relates to a grinding stone which is a metal-bonded stone using a metal material as the main material of a bonding material, which has a high stock removal rate and which is free from deterioration of the grinding ability due to clogging even in grinding with high precision for a long period of time, and a method for its production and a grinding method employing it.

Usually, a grinding stone is one having abrasive grains of e.g. diamond, cubic boron nitride (hereinafter referred to as "CBN"), silicon carbide or aluminum oxide dispersed and fixed in a bonding material. Depending upon the type of the bonding material, it is classified into a resin-bonded grinding stone using a synthetic resin material as the main bonding material material, a metal-bonded grinding stone using a metal material as the main bonding material, and a vitrified grinding stone using a ceramic material as the main bonding material.

Among them, the resin-bonded grinding stone presents a soft touch during grinding, whereby a surface having a proper surface roughness with little defects can be obtained. However, abrasion of the synthetic resin material as the bonding material is remarkable, whereby the useful life of the grinding stone is short. Whereas the metal-bonded grinding stone and a vitrified grinding stone are excellent in the grinding performance and the durability, as their bonding materials have high hardness, and particularly, the metal-bonded grinding stone has the highest grinding ability. However, their stock removal rate is poor particularly against a hard brittle material such as glass or ceramics and the abrading power decreases due to clogging of the grinding stones. Accordingly, to carry out continuous grinding, it is necessary to carry out toothing of the grinding stones frequently i.e. to chip off the surface of the grinding stones to expose a fresh surface to regain the stock removal rate.

In order to solve such problems of conventional metal-bonded grinding stones, for example, JP-A-63-295180 discloses a diamond grinding stone having a high mechanical strength and having a strong sintered structure formed by mixing abrasive grains with iron powder and amorphous carbon powder, followed by press-molding and sintering, and a process for its production (prior art 1). Further, JP-A-7-251378 discloses a porous iron-type metal diamond grinding stone wherein the grinding stone is porous so that the bonding strength of the bonding material is controlled so that in the grinding operation, the bonding material will be abraded properly without resistance thereby to suppress clogging, and the bonding material is an iron type metal, and further, as a bonding material material, carbon is used to control the abrasive grain-holding strength and the mechanical properties of the bonding material portion, and a process for its production (prior art 2).

In the above-mentioned prior arts 1 and 2, the hardness and the bonding strength of the entire grinding stone are increased by using iron or an iron-type metal as the bonding material. Further, it is disclosed that by providing pores in the grinding stone or by adding the carbon component, it is possible to prevent deterioration of the stock removal rate due to clogging, by an autogenous function i.e. scraping of the surface of the grinding stone by a proper degree of grinding, whereby it is possible to obtain a grinding stone which is less susceptible to clogging.

However, according to a verification conducted by the present inventors, since the bonding material which can be used in the prior art 1 or the prior art 2 is limited to iron or its alloy, it is not possible to select a bonding material suitable for an object to be ground, and in some cases, it is not possible to obtain a highly precise treated surface. Further, in the prior art 1, the amount of the carbon powder component which can be added, is limited to a relatively small level, and the autogenous function of the grinding stone can hardly be said to be sufficient. Also the pores in the prior art 2 are limited in the effect of the autogenous function, whereby depending upon the object to be ground or the grinding method, it has been still difficult to maintain a high grinding performance while preventing clogging.

The present invention has been made to solve such problems, and it is an object of the present invention to provide a grinding stone having a high stock removal rate and having an excellent autogenous function not to undergo deterioration of the grinding ability due to clogging even by grinding for a long period of time with high precision, even against an object to be ground made of a hard brittle material, and a process for its production and a grinding method employing it.

The present invention provides a grinding stone using a bonding material made of a metal material as the main material, which comprises:

(A) abrasive grains of at least one member selected from the group consisting of diamond, cubic boron nitride, silicon carbide and aluminum oxide, (B) a bonding material made of at least one metal member selected from the group consisting of cobalt, nickel and copper, or a bonding material made of an alloy comprising at least one member selected from the group consisting of cobalt, nickel and copper, and at least one member selected from the group consisting of iron, silver, tin, zinc and tungsten, and (C) amorphous carbon as an adjuvant, wherein the abrasive grains (A) and the amorphous carbon (C) are distributed in the bonding material (B) in a sea-island structure.

Further, the present invention provides a process for producing a grinding stone, which comprises mixing, as the main components:

(a) abrasive grains of at least one member selected from the group consisting of diamond, cubic boron nitride, silicon carbide and aluminum oxide, (b) a bonding material (b1) made of at least one metal member selected from the group consisting of cobalt, nickel and copper, or a bonding material (b2) made of an alloy comprising at least one member selected from the group consisting of cobalt, nickel and copper, and at least one member selected from the group consisting of iron, silver, tin, zinc and tungsten, and (c) an adjuvant comprising, as the main material, a synthetic resin material, of which the carbon content remaining after carbonization is at least 50%, compression-molding the mixture into a predetermined grinding stone shape, and sintering the molded product.

Still further, the present invention provides a grinding method which comprises grinding an object to be ground, made of a metal material or an oxide material, by means of the grinding stone as mentioned above.

The present invention also provides a grinding method which comprises grinding an object to be ground, made of a metal material or an oxide material, by means of the grinding stone produced by the process as mentioned above.

Figure 1A:
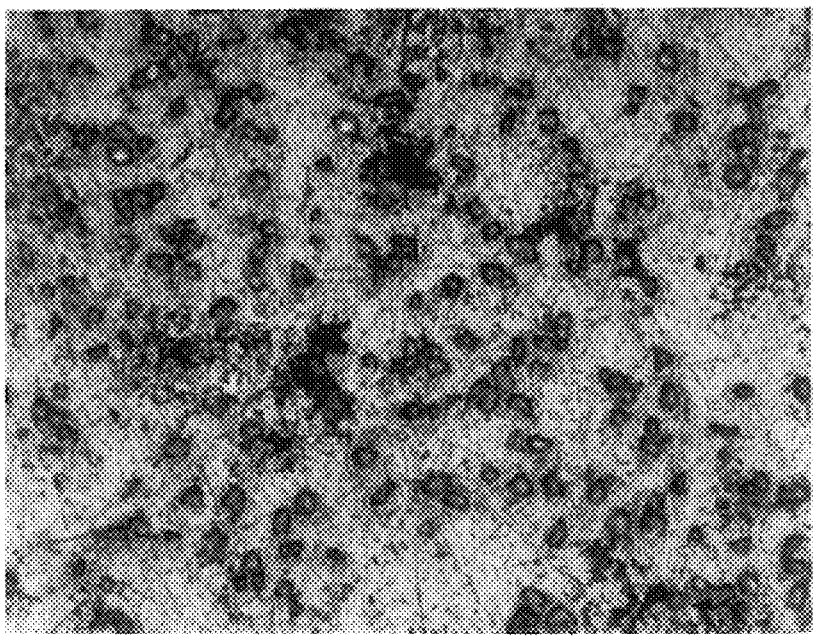
FIG. 1(*a*) is a microscopic photograph of a grinding stone of the present invention, and FIG. 1(*b*) is the same photograph with reference numerals for its description.

In the Figures, reference numeral 1 indicates abrasive grains, 2 a bonding material, and 3 amorphous carbon.

Now, the present invention will be described in further detail. However, the following description is intended to facilitate understanding of the present invention and by no means restricts the present invention.

Abrasive Grains

The abrasive grains as one of the components of the grinding stone of the present invention are made of at least one member selected from the group consisting of diamond, CBN, silicon carbide and aluminum oxide i.e. basically a material having a high hardness. Further, the content of the abrasive grains in the grinding stone is from 1 to 30 vol % based on the total amount of the grinding stone. If the content of the abrasive grains is too large, the stock removal rate decreases although the useful life of the grinding stone may be prolonged, and if it is too small, the useful life of the grinding stone will be short.

Bonding Material

The bonding material as one of the components of the grinding stone of the present invention is at least one metal member selected from the group consisting of cobalt, nickel and copper, or an alloy comprising at least one member selected from the group consisting of cobalt, nickel and copper and at least one member selected from the group consisting of iron, silver, tin, zinc and tungsten. The content of the bonding material in the grinding stone is not particularly limited so long as it is an amount sufficient for the bonding material of a metal or an alloy to form a continuous phase. It is preferably at least 30 vol % based on the total amount of the grinding stone.

Adjuvant

The adjuvant as one of the components of the grinding stone of the present invention is amorphous carbon. This adjuvant assists the bonding material of a metal or the like for bonding thereby to realize a high stock removal rate and at the same time to make it possible to obtain a highly precise ground surface. This amorphous carbon is one obtained by carbonization of a synthetic resin material. The synthetic resin material to be used, is preferably one having a little volume change during the carbonization i.e. one having a large content of carbon remaining during baking for carbonization, whereby the grinding stone strength after the baking tends to increase. It is preferably a phenol resin, of which the carbon content remaining after carbonization is at least 50%.

The content of the amorphous carbon as the adjuvant containing in the grinding stone is from 1 to 40 vol %, preferably from 10 to 40 vol %, more preferably from 20 to 30 vol %, based on the total amount. This content is the content of the amorphous carbon in the grinding stone and thus is different from the blend proportion of the synthetic resin material (the phenol resin) as the starting material. Accordingly, for example, if it is known that the volume of the synthetic resin material as the starting material will decrease 50% by the carbonization, it is necessary to add the synthetic resin material in an amount twice as much at the time of mixing starting materials. Further, if the content of the amorphous carbon is large, the useful life of the grinding stone tends to be short although the hardness of the bonding phase may be improved. If it is too small, the autogenous function of the grinding stone tends to be hardly obtained, and clogging tends to occur during grinding.

Grinding Stone and Process for Its Production

The grinding stone of the present invention comprises the above-mentioned respective components i.e. abrasive grains of at least one member selected from the group consisting of diamond, CBN, silicon carbide and aluminum oxide, a bonding material made of at least one metal member selected from the group consisting of cobalt, nickel and copper, or a bonding material made of an alloy comprising at least one member selected from the group consisting of cobalt, nickel and copper and at least one member selected from the group consisting of iron, silver, tin, zinc and tungsten, and amorphous carbon as an adjuvant, in prescribed proportions. The process for its production comprises mixing the starting materials for the above-mentioned respective components, i.e. the abrasive grains, the bonding material and the adjuvant, so that they will be prescribed proportions after the production, molding the mixture by compression-molding into a predetermined grinding stone shape, followed by sintering to carbonize the synthetic resin material as the starting material of the adjuvant and to convert it into amorphous carbon.

The amorphous carbon thus obtained has a nature to improve the hardness of the grinding stone and thus provides a high stock removal rate as compared with a conventional grinding stone wherein a carbon powder or an amorphous carbon powder is merely added as a bonding material. Further, with such a conventional grinding stone having a carbon powder or an amorphous carbon powder incorporated, the bonding material is limited to iron or its alloy, and it has not been known to use any other metal, and it has been necessary to control the content to a level of at most a few %. Whereas, when the process for producing the grinding stone of the present invention is employed, it is possible not only to remarkably increase the content of the amorphous carbon to a level of up to 40% but also to remove the restriction to the metal and alloy as a bonding material for the amorphous carbon, since at the time of molding, it is present in the form of a synthetic resin material (phenol resin) and will be carbonized in the step of sintering and thus will not hinder the sintering of the bonding material, whereby selection of the bonding material within a wide range will be possible. Further, as the content of amorphous carbon can be increased, the content of the synthetic resin material (the phenol resin) during the production can be increased, which helps the moldability at the time of the compression molding and which serves to improve the hardness of the grinding stone during grinding and to promote the autogenous function of the grinding stone, whereby it will be further possible that the object thereby ground will have a highly precise ground surface.

Figure 1B:
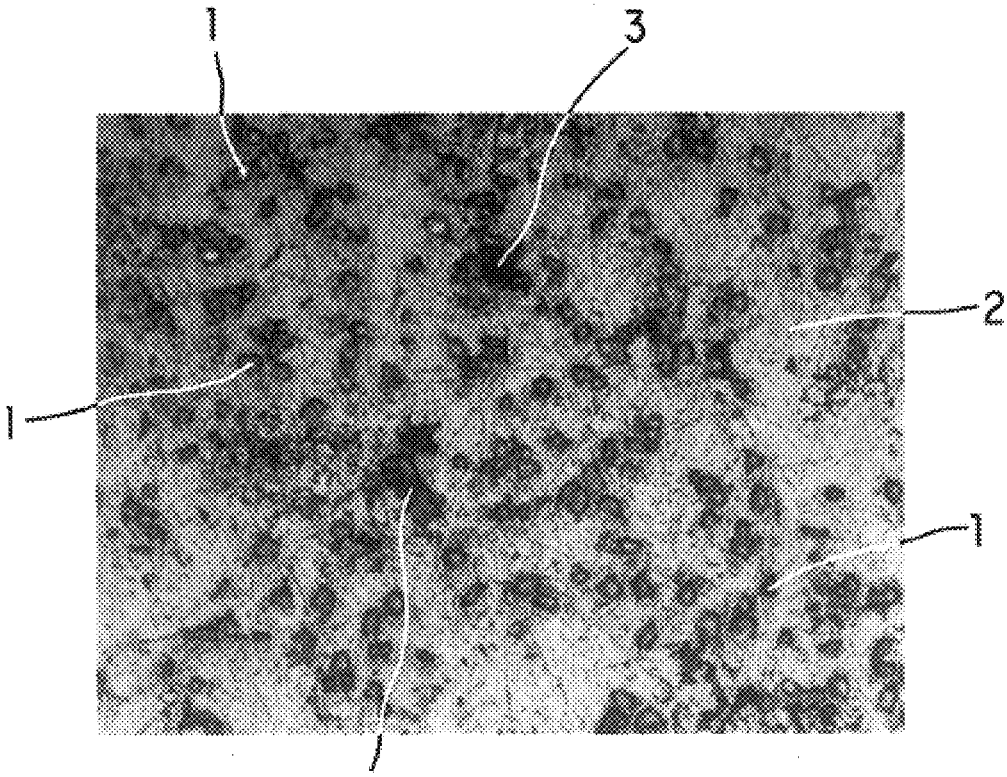
Figure 2A:
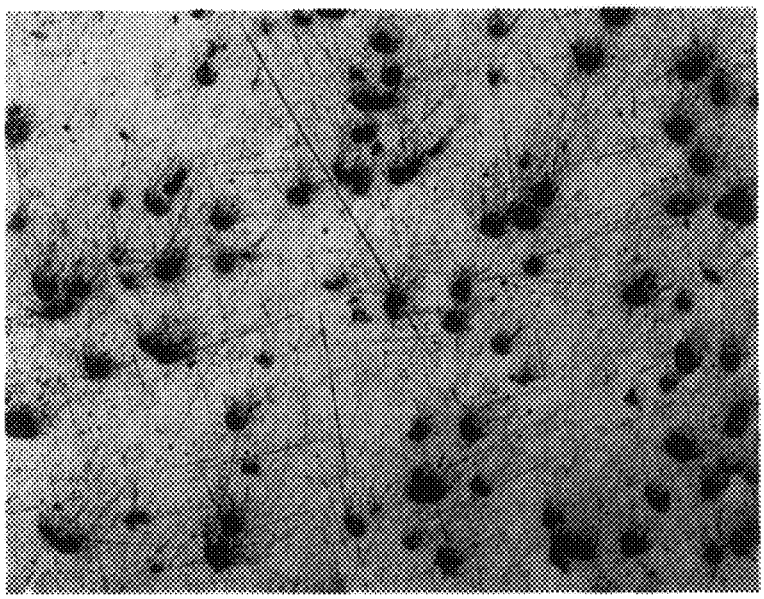
FIG. 2(*a*) is a microscopic photograph of a conventional grinding stone and FIG. 2(*b*) is the same photograph with reference numerals for its description.
Figure 2B:
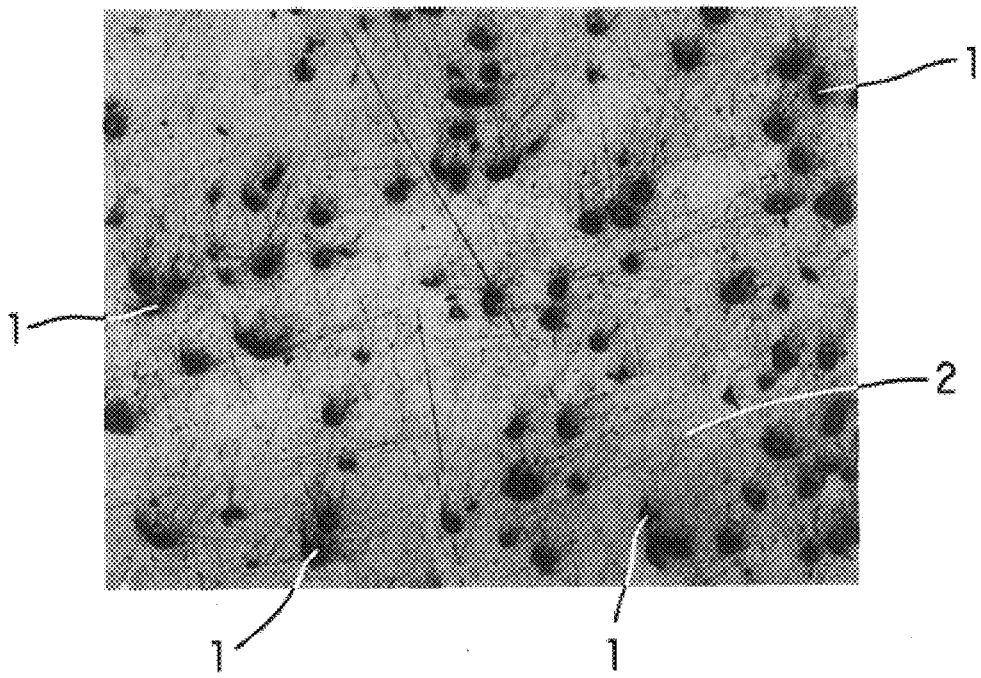

In the process for producing a grinding stone of the present invention, the above-mentioned respective components (starting materials) are uniformly mixed. This is necessary to ensure that as shown in the microscopic photograph (magnifications: 200) in FIG. 1 (a) and the same photograph with reference numerals in FIG. 1(*b*), after the production, abrasive grains 1 (diamond in FIGS. 1(*a*) and (*b*)) and amorphous carbon 3 are distributed in the grinding stone (in the bonding material 2 (in FIGS. 1(*a*) and (*b*), a mixture of iron powder and tin powder)) uniformly and in a sea-island structure wherein the amorphous carbon 3 is continuously or non-continuously dispersed. By such a sea-island structure, the hardness and brittleness of the grinding stone can be adjusted to provide a high stock removal rate and a high autogenous function with high precision. The microscopic photograph (magnifications: 200) in FIG. 2 (*a*) and the same photograph with reference numerals in FIG. 2 (*b*) show a conventional grinding stone, wherein abrasive grains 1 (diamond) are dispersed in the grinding stone (the bonding material 2 (a mixture of iron powder and tin powder)).

Then, in the process for producing the grinding stone of the present invention, the above-mentioned mixture having the respective components (the starting materials) uniformly mixed, is molded by compression molding into a predetermined grinding stone shape. The molding method is not particularly limited, and it may, for example, be an intrusion process or a flat sheet extrusion method. The intrusion process is preferred. The grinding stone may be molded into a various shape such as a pellet, segment or cup shape. The pressure and the temperature for molding are not particularly limited. The molding temperature is usually from 100 to 200° C.

Then, in the process for producing the grinding stone of the present invention, the molded product formed by compression molding, is sintered. The time and the treating temperature for this sintering are required to be sufficient to carbonize the phenol resin as the synthetic resin material i.e. the starting material for amorphous carbon as one of the components of the grinding stone. The treating temperature is from 600 to 1100° C. If sintering is carried out at a temperature exceeding this range, an adverse effect is likely to result such that the abrasive grains and the metal or the like as the bonding material tend to be oxidized. In order to prevent such oxidation, the sintering may be carried out in a non-oxidizing atmosphere i.e. in an inert atmosphere or a reducing atmosphere.

Grinding Method

The grinding method of the present invention comprises grinding an object to be ground, by means of a grinding stone which comprises the above-mentioned respective components, i.e. abrasive grains of at least one member selected from the group consisting of diamond, CBN, silicon carbide and aluminum oxide, a bonding material made of at least one metal selected from the group consisting of cobalt, nickel and copper, or a bonding material made of an alloy comprising at least one member selected from the group consisting of cobalt, nickel and copper and at least one member selected from the group consisting of iron, silver, tin, zinc and tungsten, and amorphous carbon as adjuvant, wherein the abrasive grains and the adjuvant (amorphous carbon) are distributed in the grinding stone (the bonding material) in a sea-island structure.

As compared with a grinding method employing a conventional grinding stone (a metal-bonded grinding stone), with this grinding method, the autogenous function of the grinding stone can optionally be set depending upon the proportion of the amorphous carbon, whereby a constant grinding property can be obtained, and even when compared with a grinding method employing a conventional vitrified grinding stone, it is possible to obtain an excellent ground surface by adjusting the bonding material (metal or the like) in the bonding phase, and the adjuvant (amorphous carbon).

In the grinding method of the present invention, the object to be ground may, for example, be a hard, brittle material (an oxide material) such as glass or ceramics, or a metal material. The grinding machine to be employed, may, for example, be a surface grinding machine, a cylindrical grinding machine or a creep feed grinding machine, and among them, the surface grinding machine is preferred. Particularly, in the case of a double-sided grinding machine among surface grinding machines, in a case where both sides of an object to be ground are sandwiched between grinding stones to grind the front and back sides simultaneously, if the object to be ground is a brittle material, the pressure during grinding can not be made high. Accordingly, by employing grinding stones having a large content of the amorphous carbon i.e. having a high autogenous function, it becomes possible to continuously carry out grinding constantly even under a low grinding pressure. Needless to say, the grinding stone provides an excellent effect also for usual surface grinding or for any other method.

Now, the present invention will be described in further detail with reference to Examples. However, it should be understood that the present invention is by no means restricted to such specific Examples.

EXAMPLES 1 to 3 and COMPARATIVE EXAMPLE 1

Preparation of Grinding Stones

A phenol resin powder (BELLPEARL, trade name, manufactured by Kanebo Ltd.) as a starting material for amorphous carbon as an adjuvant, and diamond (average particle size: 6.5 μm) as abrasive grains, were mixed to a copper powder and a tin powder as bonding materials in the blend ratio as identified in Table 1. Then, this mixture was compression-molded under a pressure of 98 MPa at a molding temperature of about 185° C. to obtain a cylindrical pellet having a diameter of 10 mm and a thickness of 5 mm. Such a molded product was heat-treated (sintered) in a nitrogen atmosphere at a treating temperature of 700° C. (the temperature raising rate of 100° C./hr, and the retention time after the temperature rise was 1 hour) for a total time of about 8 hours. In this manner, grinding stones of Examples 1 to 3 and Comparative Example 1 were prepared. Comparative Example 1 was one containing no phenol resin powder as an adjuvant. Further, the grinding stone shown in FIGS. 1(*a*) and (*b*) is one obtained in Example 1, and the grinding stone shown in FIGS. 2(*a*) and (*b*) is one obtained in Comparative Example 1.

TABLE 1

| | Blend ratio (vol %) | | | | |
|---|---|---|---|---|---|
| | Copper powder | Tin powder | Resin powder | Diamond abrasive grains | Rockwell hardness (HRF) |
| Example 1 | 67 | 7 | 20 | 6 | 73.9 |
| Example 2 | 58 | 6 | 30 | 6 | 90.2 |
| Example 3 | 49 | 5 | 40 | 6 | 95.2 |
| Comparative Example 1 | 86 | 8 | 0 | 6 | 44.0 |

Hardness Test

With respect to the respective compositions of Examples 1 to 3 and Comparative Example 1, the hardnesses were measured by F scale by means of a Rockwell hardness meter, and the hardness comparison was carried out. The obtained results are shown in Table 1.

Preparation of Grinding Tools 70 grinding stones prepared in each of Examples 1 and 3 and Comparative Example 1, were uniformly bonded on one surface of a flat grinding dish by an adhesive (QUICKSET, trade name, for an epoxy type adhesive, manufactured by Konishi Co., Ltd.), and the surfaces of the respective grinding stones were skived to be flat to align with the surface of the object to be ground, thereby to obtain a grinding tool corresponding to each of Examples 1 and 3, and Comparative Example 1.

Grinding Test

Then, using the respective grinding tools corresponding to Examples 1 and 3 and Comparative Example 1, the surface of soda-lime glass as an object to be ground, was subjected to grinding under the following conditions.

| | |
|---|---|
| Test machine: | Oskar-type lens lapping machine |
| Object to be ground: | soda-lime glass (disk-shaped glass having a diameter of 65 mm and a thickness of 5 mm) |
| Pressure for grinding: | 4 kg against the soda-lime glass |
| Rotational speed of the grinding tool: | 400 rpm |
| Cooling liquid for grinding: | about 5% of a water-soluble grinding liquid added to city water |
| Time for grinding: | 10 minutes |

After the grinding, the weight of each soda-lime glass was measured, and the stock removal rate was obtained from the weight reduction as compared with the weight before the grinding. Further, with respect to each soda-lime glass after the grinding, the surface roughness was measured under the following conditions by means of a fealer type roughness meter manufactured by Kosaka Kenkyusho K. K.

| | |
|---|---|
| Longitudinal magnifications: | 10,000 times |
| Transverse magnifications: | 20 times |
| Measured length: | 10 mm |
| Measuring speed: | 0.1 mm/sec |
| Cutoff: | $\lambda c = 0.08$ mm |

Further, each soda-lime glass after grinding was washed with pure water and dried, whereupon the surface of each soda-lime glass was visually inspected under a spotlight to evaluate the presence or absence of scratch marks. The evaluation standards are as follows.

○: No scratch marks are observed.

Δ: Scratch marks are slightly observed, but they are not a problematic level.

X: Substantial scratch marks are observed.

Further, using the respective grinding stones of Examples 1 and 3 and Comparative Example 1, grinding under the above conditions was carried out five times continuously against the soda-lime glass, whereupon the continuous processing property (the stock removal rate of the fifth processing÷the stock removal rate of the first processing× 100 [%]) was determined from the weight reduction (the stock removal rate) by the first processing and the weight reduction (the stock removal rate) by the fifth processing, of each soda-lime glass.

The results of evaluation of the stock removal rate, the surface roughness, the presence or absence of scratch marks and the continuous processing property, are shown in Table 2.

TABLE 2

| | Stock removal rate (μm/10 min) | Surface roughness (Rmax μm) | Presence or absence of scratch marks | Continuous processing property |
|---|---|---|---|---|
| Example 1 | 130 | 1.2 | ○ | 90% |
| Example 3 | 150 | 1.4 | ○ | 95% |
| Comparative Example 1 | 80 | 2.5 | X | 60% |

As is evident from Table 1, in each of Examples 1 to 3, the hardness is higher than in Comparative Example 1, and in Examples 1 to 3, the hardness of the bonding phase becomes high as the proportion of the phenol resin (the amorphous carbon) contained in the respective grinding stones increases.

Further, as is evident from Table 2, in each of Examples 1 and 3, the stock removal rate was higher than in Comparative Example 1. This indicates that the hardness of the bonding phase becomes high when amorphous carbon is contained in the grinding stone, whereby a high stock removal rate can be obtained. Further, in each of Examples 1 and 3, the ground surface free from scratch marks was obtained with the surface roughness smaller than in Comparative Example 1. This indicates that a high stock removal rate can be provided, and highly precise grinding can be carried out when amorphous carbon is contained in the grinding stone. Further, in each of Examples 1 and 3, the continuous processing property was higher than in Comparative Example 1. This indicates that not only the hardness but also the brittleness is improved. Thus, it has been found that when amorphous carbon is contained in the grinding stone, no deterioration in the grinding ability due to clogging takes place even in a grinding operation for a long period of time, and it is possible to obtain a grinding stone having a high autogenous function and which is capable of carrying out grinding constantly. Further, it is evident that in Examples 1 and 3, the continuous processing property i.e. the autogenous function varies depending upon the proportion of the amorphous carbon contained in the grinding stone. Thus, it is evident that the autogenous function can be adjusted depending upon the object to be ground, so that highly precise grinding can be carried out.

EXAMPLES 4 to 6 and COMPARATIVE EXAMPLE 2

Preparation of Grinding Stones

A phenol resin powder (BELLPEARL, trade name, manufactured by Kanebo Ltd) as a starting material for amorphous carbon as an adjuvant, and diamond (average particle size: 6.5 μm) as abrasive grains, were mixed to a nickel powder, a copper powder and a tin powder as bonding materials in the blend ratio as shown in Table 3. Then, the mixture was compression-molded under a pressure of 294 MPa at room temperature to obtain a cylindrical pellet having a diameter of 10 mm and a thickness of 5 mm. This molded product was heat-treated (sintered) in a nitrogen atmosphere at a treating temperature of 700° C. (the temperature raising rate of 300° C./hr, and the retention time after the temperature rise was 1 hr) for a total time of about 3.5 hours. In this manner, the respective grinding stones of Examples 4 to 6 and Comparative Example 2 were prepared. Comparative Example 2 was one containing no phenol resin powder as an adjuvant.

TABLE 3

| | Blend ratio (vol %) | | | | |
|---|---|---|---|---|---|
| | Copper powder | Tin powder | Resin powder | Diamond abrasive grains | Rockwell hardness (HRF) |
| Example 4 | 67 | 7 | 20 | 6 | 63.0 |
| Example 5 | 58 | 6 | 30 | 6 | 76.7 |
| Example 6 | 49 | 5 | 40 | 6 | 81.8 |
| Comparative Example 2 | 86 | 8 | 0 | 6 | 44.0 |

Hardness Test

With respect to the respective compositions of Examples 4 to 6 and Comparative Example 2, the hardness comparison was carried out by the same method as in Examples 1 to 3. The obtained results are shown in Table 3.

Grinding Test

Using 70 grinding stones prepared in each of Examples 4 and 6 and Comparative Example 2, a grinding tool corresponding to Example 4 or 6 or Comparative Example 2 was prepared in the same manner as in Example 1, and grinding of soda-lime glass was carried out by means of an Oskar-type lens lapping machine, whereby the stock removal rate, the surface roughness and the presence or absence of scratch marks were evaluated. The results of evaluation are shown in Table 4.

TABLE 4

| | Stock removal rate (μm/10 min) | Surface roughness (Rmax μm) | Presence or absence of scratch marks | Continuous processing property |
|---|---|---|---|---|
| Example 4 | 110 | 1.3 | ○ | 80% |
| Example 6 | 130 | 1.6 | Δ | 85% |
| Comparative Example 2 | 80 | 2.5 | X | 60% |

As is evident from Table 3, in each of Examples 4 to 6, the hardness is higher than in Comparative Example 2, and in Examples 4 to 6, the hardness of the bonding phase becomes high as the proportion of the phenol resin (the amorphous carbon) contained in the respective grinding stones increases.

Further, as is evident from Table 4, in each of Examples 4 and 6, the stock removal rate was higher than in Comparative Example 2. This indicates that the hardness of the bonding phase becomes high when amorphous carbon is contained in the grinding stone, whereby a high stock removal rate can be obtained. Further, in each of Examples 4 and 6, the ground surface free from scratch marks was obtained with the surface roughness smaller than in Comparative Example 2. This indicates that a high stock removal rate can be provided, and highly precise grinding can be carried out when amorphous carbon is contained in the grinding stone. Further, in each of Examples 4 and 6, the continuous processing property was higher than in Comparative Example 2. This indicates that not only the hardness but also the brittleness is improved. Thus, it has been found that when amorphous carbon is contained in the grinding stone, no deterioration in the grinding ability due to clogging takes place even in a grinding operation for a long period of time, and it is possible to obtain a grinding stone having a high autogenous function and which is capable of carrying out grinding constantly. Further, it is evident that in Examples 4 and 6, the continuous processing property i.e. the autogenous function varies depending upon the proportion of the amorphous carbon contained in the grinding stone. Thus, it is evident that the autogenous function can be adjusted depending upon the object to be ground, so that highly precise grinding can be carried out.

EXAMPLES 7 to 9 and COMPARATIVE EXAMPLE 3

Preparation of Grinding Stones

A phenol resin powder (BELLPEARL, trade name, manufactured by Kanebo Ltd.) as the starting material for amorphous carbon as an adjuvant, and diamond (average particle size: 5 μm) as abrasive grains, were mixed to a nickel powder, a copper powder and a tin powder as bonding materials in the blend ratio as shown in FIG. 5. Then, the mixture was compression-molded under a pressure of 196 MPa at a molding temperature of about 180° C. to obtain a cylindrical pellet having a diameter of 10 mm and a thickness of 5 mm. The molded product was heat-treated (sintered) in a nitrogen atmosphere at a treating temperature of 1,000° C. (the temperature raising rate of 500° C./hr, and the retention time after the temperature rise was 1 hour) for a total time of about 3 hours. In this manner, the respective grinding stones of Examples 7 to 9 and Comparative Example 3 were prepared. Comparative Example 3 was one containing no phenol resin powder as an adjuvant.

TABLE 5

| | Blend ratio (vol %) | | | | | |
|---|---|---|---|---|---|---|
| | Nickel | Copper | Tin | Resin | Diamond abrasive grains | Rockwell hardness (HRF) |
| Ex. 7 | 53 | 23 | 9 | 10 | 5 | 94.0 |
| Ex. 8 | 47 | 20 | 8 | 20 | 5 | 91.0 |
| Ex. 9 | 41 | 17 | 7 | 30 | 5 | 88.0 |
| Comp. Ex. 3 | 59 | 26 | 10 | 0 | 5 | 85.0 |

Hardness Test

With respect to the respective compositions of Examples 7 to 9 and Comparative Example 3, the hardness comparison was carried out by the same method as in Examples 1 to 3. The obtained results are shown in Table 5.

Grinding Test

Using 70 grinding stones prepared in each of Examples 7 and 9 and Comparative Example 3, a grinding tool corresponding to Example 7 or 9 or Comparative Example 3 was prepared by the same method as in Example 1, and grinding of soda-lime glass was carried out by means of an Oskar-type lens lapping machine, whereby the stock removal rate, the surface roughness and the presence or absence of scratch marks, were evaluated. The evaluation results are shown in Table 6.

TABLE 6

| | Stock removal rate (μm/10 min) | Surface roughness (Rmax μm) | Presence or absence of scratch marks | Continuous processing property |
|---|---|---|---|---|
| Example 7 | 90 | 0.9 | ○ | 90% |
| Example 9 | 100 | 1.1 | ○ | 95% |
| Comparative Example 3 | 70 | 1.6 | X | 30% |

As is evident from Table 5, in each of Examples 7 to 9, the hardness is higher than in Comparative Example 3. However, the metal phase of Comparative Example 3 has high hardness. Accordingly, even when the phenol resin is added as in Examples 7 to 9, the hardness is not as higher than in Comparative Example 3. Further, the hardness of the bonding phase does not become high, even when the proportion of the phenol resin (the amorphous carbon) increases.

However, as is evident from Table 6, in each of Examples 7 and 9, the stock removal rate was higher than in Comparative Example 3, further, the continuous processing property is very high, and as the proportion of the amorphous carbon-increases, both the stock removal rate and the continuous processing property become high. This indicates that not only the hardness but also the brittleness is improved. Thus, it has been found that when amorphous carbon is contained in the grinding stone, no deterioration in the grinding ability due to clogging takes place even in a grinding operation for a long period of time, and it is possible to obtain a grinding stone having a high autogenous function and which is capable of carrying out grinding constantly. Further, it is evident that in Examples 7 and 9, the surface roughness was smaller than in Comparative Example 3, and a treated surface free from scratch marks was obtained. Thus, it is evident that when the amorphous carbon is incorporated in the grinding stone, the autogenous function can be adjusted depending upon the object to be ground, so that highly precise grinding can be carried out.

As described in the foregoing, the grinding stone of the present invention is a grinding stone using a bonding material made of a metal material as the main material, which comprises:

(A) abrasive grains of at least one member selected from the group consisting of diamond, cubic boron nitride, silicon carbide and aluminum oxide, (B) a bonding material (B1) made of at least one metal member selected from the group consisting of cobalt, nickel and copper, or a bonding material (B2) made of an alloy comprising at least one member selected from the group consisting of cobalt, nickel and copper, and at least one member selected from the group consisting of iron, silver, tin, zinc and tungsten, and (C) amorphous carbon as an adjuvant, wherein the abrasive grains (A) and the amorphous carbon (C) are distributed in the bonding material (B) in a sea-island structure. Due to the amorphous carbon (C) of the sea-island structure, the hardness of the bonding phase increases, and it is possible to obtain a grinding stone having a high stock removal rate. Further, highly precise grinding can be attained, and at the same time, the grinding stone has brittleness. Accordingly, it is possible to obtain a grinding stone whereby highly autogenous constant grinding can be carried out without causing deterioration of the grinding ability due to clogging even in grinding for a long period of time.

In the grinding stone of the present invention, the synthetic resin material as the main material of the amorphous carbon (C) is a phenol resin, and accordingly, even if it is carbonized by sintering, the volume change is little, and the grinding stone strength after the sintering can be made high, and it is possible to obtain a grinding stone having a high stock removal rate.

In the grinding stone of the present invention, the content of the abrasive grains (A) is within a range of from 1 to 30 vol % based on the total amount of the grinding stone, and the content of the amorphous carbon (C) is within a range of from 1 to 40 vol % based on the total amount of the grinding stone, whereby it is possible to obtain a grinding stone having a high stock removal rate and autogenous function.

The process for producing a grinding stone of the present invention is a process for producing a grinding stone, which comprises mixing, as the main components:

(a) abrasive grains of at least one member selected from the group consisting of diamond, cubic boron nitride, silicon carbide and aluminum oxide, (b) a bonding material (b1) made of at least one metal member selected from the group consisting of cobalt, nickel and copper, or a bonding material (b2) made of an alloy comprising at least one member selected from the group consisting of cobalt, nickel and copper, and at least one member selected from the group consisting of iron, silver, tin, zinc and tungsten, and (c) an adjuvant comprising, as the main material, a synthetic resin material, of which the carbon content remaining after carbonization is at least 50%, compression-molding the mixture into a predetermined grinding stone shape, and sintering the molded product.

By this process, the proportion of the amorphous carbon can be made large, whereby a high stock removal rate can be obtained. Further, the adjuvant is present in the form of a synthetic resin material at the time of molding and will be carbonized in the sintering step, and thus, it does not hinder sintering of the bonding material, whereby selection of the bonding material within a wide range will be possible. Further, by increasing the proportion of the amorphous carbon, the proportion of the synthetic resin material during the production will be large, which helps moldability at the time of compression molding, will improve the hardness of the grinding stone at the time of grinding, will promote the autogenous function of the grinding stone and further makes it possible that the ground object will have a highly precise ground surface.

The process for producing a grinding stone of the present invention is a process wherein the abrasive grains (a), the bonding material (b) and the adjuvant (c) are mixed so that the content of the abrasive grains (a) after sintering would be within a range of from 1 to 30 vol % based on the total weight of the grinding stone, and the content of the adjuvant (c) after sintering would be within a range of from 1 to 40 vol % based on the total weight of the grinding stone, whereby it is possible to obtain a grinding stone having a high stock removal rate and autogenous function.

The process for producing a grinding stone of the present invention is a process wherein the sintering is carried out at a treating temperature within a range of from 600 to 1,100° C. and in a non-oxidizing atmosphere, whereby the synthetic resin material can adequately be carbonized, and oxidation of the abrasive grains and the bonding material can be prevented, whereby it is possible to obtain a grinding stone having a high hardness.

The grinding method using the grinding stone of the present invention is a method which comprises grinding an object to be ground, made of a metal material or an oxide material, by means of a grinding stone comprising the abrasive grains (A), the bonding material (B) and the amorphous carbon (C), wherein the abrasive grains (A) and the amorphous carbon (C) are distributed in the bonding material (B) in a sea-island structure, whereby a high stock removal rate and a highly precise grinding operation can be attained. Further, the autogenous function of the grinding stone can optionally be set depending upon the content of the amorphous carbon, whereby a constant grinding performance can be obtained.

The grinding method using the grinding stone of the present invention is a method which comprises grinding an object to be ground, made of a metal material or an oxide material, by means of a grinding stone produced by a process which comprises mixing, as the main components, the abrasive grains (a), the bonding material (b) and the adjuvant (c), compression-molding the mixture into a predetermined grinding stone shape, and sintering the molded product, whereby it is possible to attain a highly precise grinding.

The grinding method using the grinding stone of the present invention is a method wherein the object to be ground is glass, whereby it is possible to attain a highly precise grinding performance also against a hard brittle material.

The grinding method using the grinding stone of the present invention is a method wherein surface grinding is applied to the object to be ground, whereby even under a low grinding pressure, constant grinding can continuously be carried out.

The entire disclosure of Japanese Patent Applications No. 11-372154 filed on Dec. 28, 1999 and No. 2000-352068 filed on Nov. 20, 2000 including specification, claims, drawings and summary are incorporated herein by reference in its entirety.

What is claimed is:

1. A metal-bonded grinding stone which comprises:

(A) abrasive grains of at least one member selected from the group consisting of diamond, cubic boron nitride, silicon carbide and aluminum oxide, (B) a bonding material made of at least one metal selected from the group consisting of cobalt, nickel and copper, or a bonding material made of an alloy comprising at least one member selected from the group consisting of cobalt, nickel and copper, and at least one member selected from the group consisting of iron, silver, tin, zinc and tungsten, and (C) amorphous carbon derived from a synthetic resin as an adjuvant, wherein the abrasive grains (A) and the amorphous carbon (C) are distributed in the bonding material (B) in a sea-island structure.

2. The metal-bonded grinding stone according to claim 1, wherein the amorphous carbon (C) is obtained by sintering and carbonizing the synthetic resin material.

3. The metal-bonded grinding stone according to claim 2, wherein the synthetic resin material is a phenol resin.

4. The metal-bonded grinding stone according to claim 1, wherein the content of the abrasive grains (A) is within a range of from 1 to 30 vol % based on the total amount of the grinding stone, and the content of the amorphous carbon (C) is within a range of from 1 to 40 vol % based on the total amount of the grinding stone.

5. The metal-bonded grinding stone according to claim 1, wherein the grinding stone has a pellet shape and a flat grinding surface.

6. A process for producing a metal-bonded grinding stone, which comprises mixing:

(a) abrasive grains of at least one member selected from the group consisting of diamond, cubic boron nitride, silicon carbide and aluminum oxide, (b) a bonding material made of at least one metal selected from the group consisting of cobalt, nickel and copper, or a bonding material made of an alloy comprising at least one member selected from the group consisting of cobalt, nickel and copper, and at least one member selected from the group consisting of iron, silver, tin, zinc and tungsten, and (c) an adjuvant comprising a synthetic resin material, compression-molding the mixture into a shape of a grinding stone and sintering the molded product, whereby the synthetic resin material is carbonized to an extent that carbon remaining is at least 50% of the synthetic resin material volume prior to carbonization.

7. The process for producing a metal-bonded grinding stone according to claim 6, wherein the synthetic resin material is a phenol resin.

8. The process for producing a metal-bonded grinding stone according to claim 6, wherein the abrasive grains (a), the bonding material (b) and the adjuvant (c) are mixed so that the content of the abrasive grains (a) after the sintering is within a range of from 1 to 30 vol % based on the total amount of the grinding stone, and the content of the adjuvant (c) after the sintering is within a range of from 1 to 40 vol % based on the total amount of the grinding stone.

9. The process for producing a metal-bonded grinding stone according to claim 6, wherein the sintering is carried out at a treating temperature within a range of from 600 to 1,100°C. in a non-oxidizing atmosphere.

10. The process for producing a metal-bonded grinding stone according to claim 6, wherein the compression molding is carried out so that the grinding stone shape after the sintering has a pellet shape and a flat grinding surface.

11. A grinding method which comprises grinding a metal-containing or oxide-containing object with the grinding stone as defined in claim 1.

12. A grinding method which comprises grinding a metal-containing or oxide-containing object with the grinding stone produced by the process as defined in claim 6.

13. The grinding method according to claim 11, wherein the object to be ground is glass.

14. The grinding method according to claim 11, wherein surface grinding is applied to the object to be ground.

* * * * *